US008462391B2

(12) United States Patent
Kerz et al.

(10) Patent No.: US 8,462,391 B2
(45) Date of Patent: Jun. 11, 2013

(54) METHOD FOR PRODUCING A PSEUDO-STOCHASTIC MASTER SURFACE, MASTER SURFACE, METHOD FOR PRODUCING A CYLINDER COVER, CYLINDER COVER, MACHINE PROCESSING PRINTING MATERIAL, METHOD FOR PRODUCING PRINTED PRODUCTS AND METHOD FOR MICROSTAMPING PRINTING PRODUCTS

(75) Inventors: Ludo Kerz, Nieder-Olm (DE); Wolfram Kolbe, Heidelberg (DE); Martin Schmitt-Lewen, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 638 days.

(21) Appl. No.: 12/709,627

(22) Filed: Feb. 22, 2010

(65) Prior Publication Data

US 2010/0229741 A1 Sep. 16, 2010

(30) Foreign Application Priority Data

Mar. 13, 2009 (DE) ..... 10 2009 013 170

(51) Int. Cl.

| | |
|---|---|
| ***B41C 1/10*** | (2006.01) |
| ***B41C 1/18*** | (2006.01) |
| ***B41F 11/00*** | (2006.01) |
| ***B41F 13/08*** | (2006.01) |
| ***B41F 13/18*** | (2006.01) |
| ***B41F 13/193*** | (2006.01) |
| ***B41N 7/00*** | (2006.01) |
| ***B41N 10/00*** | (2006.01) |

(52) U.S. Cl.

USPC ..... 358/3.3; 358/3.19; 358/533; 101/136; 101/141; 101/216; 101/450.1; 101/458; 101/483

(58) Field of Classification Search

USPC ..... 358/3.06, 3.19, 3.26, 3.29, 3.3, 533–536; 101/22, 23, 32, 150, 153, 216, 219, 395, 101/401, 401.1, 450.1, 453, 463.1, 136, 141, 101/483, 458; 430/269, 300, 302, 307; 219/121.6, 121.67, 121.68, 121.72, 121.85

See application file for complete search history.

(56) References Cited

U.S. PATENT DOCUMENTS 4,131,782 A * 12/1978 Einstein et al. ..... 219/121.85
5,102,744 A * 4/1992 Wirz et al. ..... 428/600

(Continued)

FOREIGN PATENT DOCUMENTS

| | | | |
|---|---|---|---|
| DE | 4102983 | A1 | 4/1992 |
| DE | 19929904 | A1 | 1/2001 |
| DE | 102008013322 | A1 | 10/2008 |
| DE | 102008019254 | A1 | 11/2008 |
| EP | 1673230 | B1 | 12/2007 |
| EP | 2001218 | A1 * | 12/2008 |
| WO | 2004096570 | A2 | 11/2004 |
| WO | 2006112696 | A2 | 10/2006 |

OTHER PUBLICATIONS

German Search Report dated Nov. 11, 2009.

*Primary Examiner* — Scott A Rogers

(74) *Attorney, Agent, or Firm* — Laurence A. Greenberg; Werner H. Stemer; Ralph E. Locher

(57) ABSTRACT

A method for producing a pseudo-stochastic master surface for producing a cover or jacket of a cylinder for contacting printing material, includes providing the master surface with a pseudo-stochastic distribution of microsurfaces. The master surface is produced on the basis of a digital master in a jacket preliminary stage and serves for a preferably galvanic production of a microstructured cover, in which structure elevations correlate with the microsurfaces. The pseudo-stochastic distribution helps to avoid disruptive discernible effects, for example the moiré effect and helps to construct the microstructuring in a targeted manner. A master surface, a method for producing a cylinder cover, a cylinder cover, a machine for processing printing material, a method for producing printed products and a method for microstamping printed products, are also provided.

4 Claims, 3 Drawing Sheets

U.S. PATENT DOCUMENTS 5,397,651 A * 3/1995 Wirz ..... 428/600
6,766,738 B2 * 7/2004 Blumm et al. ..... 428/600
6,888,853 B1 * 5/2005 Jurgensen ..... 101/150
7,287,750 B2 10/2007 Boguhn
7,641,194 B2 1/2010 Draxler et al.
7,798,063 B2 * 9/2010 Andresen et al. ..... 101/401.1
2007/0202348 A1 8/2007 Bruckerhoff
2007/0296203 A1 12/2007 Golan
2008/0011175 A1 * 1/2008 Herzbach et al. ..... 101/453
2008/0134912 A1 6/2008 Golan
2008/0236411 A1 * 10/2008 Schaum et al. ..... 101/23
2008/0282916 A1 * 11/2008 Kolbe et al. ..... 101/401

* cited by examiner

METHOD FOR PRODUCING A PSEUDO-STOCHASTIC MASTER SURFACE, MASTER SURFACE, METHOD FOR PRODUCING A CYLINDER COVER, CYLINDER COVER, MACHINE PROCESSING PRINTING MATERIAL, METHOD FOR PRODUCING PRINTED PRODUCTS AND METHOD FOR MICROSTAMPING PRINTING PRODUCTS

CROSS-REFERENCE TO RELATED APPLICATION

This application claims the priority, under 35 U.S.C. §119, of German Patent Application DE 10 2009 013 170.1, filed Mar. 13, 2009; the prior application is herewith incorporated by reference in its entirety.

BACKGROUND OF THE INVENTION

Field of the Invention

The present invention relates to a method for producing a pseudo-stochastic master surface for producing a cover of a cylinder for contacting printing material. Furthermore, the present invention relates to a master surface for producing a cover of a cylinder for contacting printing material, to a method for producing a cover of a cylinder for contacting printing material, to a cover of a cylinder for contacting printing material, to a machine for processing printing material, in particular a sheet-processing rotary printing press for lithographic offset printing, to methods for producing printed products and to a method for microstamping printed products.

In machines in the so-called graphic industry (prepress stage, print production and further print processing), printing materials, for example paper, cardboard or films, are conveyed and processed. The printing materials can be conveyed in printing presses through the use of rotating cylinders which, for that purpose, have surfaces that make contact with printing material, preferably in the form of exchangeable cylinder covers (so-called "jackets"). The surfaces are as a rule equipped with two properties: firstly they are anti-adhesive (repelling ink, varnish and dirt) and secondly they are wear-resistant due to the mostly very hard materials being used. Furthermore, the surfaces as a rule have a mostly microscopic structure, that is to say they are not smooth, but rather of (micro-) rough configuration. That roughness reduces the contact area for the printing material and therefore reduces the possibility of ink being deposited on the surface. For some years, for example, thermally sprayed (therefore microrough), ceramic coatings with sealing compounds of low surface energy such as silicone ("PerfectJacket" product by Heidelberger Druckmaschinen AG) or galvanically produced coatings with sealing compounds of low surface energy such as chromium or a so-called sol-gel ("Mark 3" and "Transfer-Jacket" products by Heidelberger Druckmaschinen AG) have been used.

Up to now, due to the production processes being used, the structure of known covers has mostly been of a stochastic nature. A problem can occur in that case which is that predefined spacings of structure elevations or their respective width and/or height are disadvantageously undershot or exceeded (for example, by contiguous structure elevations) and the stated disadvantages of individual covers reinforce one another or are added to one another in the production of printed products. If, on the other hand, regular structures which can be produced easily are used, effects which can be discerned by the naked eye and are therefore disruptive quickly occur, such as the known moiré effect.

International Publication No. WO 2006/112696 A2 has disclosed a production method for covers, in which method, starting from a flat film which is electrically conductive on the surface and has a pattern of electrically insulating microcircle faces, a surface or a cover with regularly disposed structure elevations is produced in a multiple-step galvanic method. The height of structure elevations to be produced depends causally on the respective diameter of the circle faces. No information for producing the initial film for the cover can be gathered from International Publication No. WO 2006/112696 A2.

German Published, Non-Prosecuted Patent Application DE 10 2008 019 254 A1, corresponding to U.S. Patent Application Publication No. US 2008/0282916 A1, describes a method which builds on the disclosure of International Publication No. WO 2006/112696 A2 for producing covers with structure elevations of different height which are spaced apart in a defined ratio. The structure elevations can be disposed regularly or stochastically and can have identical or stochastically distributed heights. No information for producing the initial film can be gathered from German Published, Non-Prosecuted Patent Application DE 10 2008 019 254 A1, corresponding to U.S. Patent Application Publication No. US 2008/0282916 A1, either.

German Published, Non-Prosecuted Patent Application DE 10 2008 013 322 A1, corresponding to U.S. Patent Application Publication No. US 2008/0236411 A1, discloses a method, in which a printing material is printed and at the same time is stamped by a microstructure with an information item (security feature) which cannot be discerned by the naked eye. Reference is made to International Publication No. WO 2006/112696 A2, but no information is given for producing the initial film. In that context, European Patent EP 1 673 230 B1, corresponding to U.S. Patent Application Publication No. US 2007/0202348 A1, also discloses a method for producing a stamping die for stamping security features, with a three-dimensional digitized master being produced and the digital data being transferred onto the stamping die through the use of laser beams. International Publication No. WO 2004/096570 A2, corresponding to U.S. Patent Application Publication Nos. US 2007/0296203 A1 and US 2008/0134912 A1, also discloses the stamping of hidden information.

SUMMARY OF THE INVENTION

It is accordingly an object of the invention to provide a method for producing a pseudo-stochastic master surface, a master surface, a method for producing a cylinder cover, a cylinder cover, a machine processing printing material, a method for producing printed products and a method for microstamping or embossing printed products, which overcome the hereinafore-mentioned disadvantages of the heretofore-known methods, products and machines of this general type and which make it possible to influence the (surface) configuration or microstructuring of a cover or its digital and material precursors in a targeted and substantially reproducible manner and to avoid disruptive effects which can be discerned by the naked eye in a likewise targeted manner.

With the foregoing and other objects in view there is provided, in accordance with the invention, a method for producing a pseudo-stochastic master surface for producing a cover of a cylinder for contacting printing material. The method comprises providing the master surface with a pseudo-stochastic distribution of microsurfaces.

The pseudo-stochastic distribution of microsurfaces according to the invention makes it advantageously possible to influence the (surface) configuration or microstructuring of a cover or its digital and material precursors in a targeted and substantially reproducible manner and to avoid disruptive effects which can be discerned by the naked eye in a likewise targeted manner.

In accordance with another mode of the method of the invention, which is advantageous with regard to the avoidance of optically disruptive effects and is therefore preferred, the master surface is provided with a pseudo-stochastic microsurface positional distribution.

In accordance with a further mode of the method of the invention, which is advantageous with regard to the production of structure elevations of different heights and is therefore preferred, the master surface is provided with a pseudo-stochastic microsurface size distribution.

With the objects of the invention in view, there is also provided a master surface for producing a cover of a cylinder for contacting printing material. The master surface comprises a pseudo-stochastic distribution of microsurfaces due to a regular repetition of cells having a stochastic microsurface pattern.

With the objects of the invention in view, there is furthermore provided a method for producing a cover of a cylinder for contacting printing material. The method comprises producing a pseudo-stochastic master surface according to the invention, and producing the cover galvanically by utilizing the pseudo-stochastic master surface.

With the objects of the invention in view, there is additionally provided a cover of a cylinder for contacting printing material. The cover comprises pseudo-stochastic structuring formed by a regular repetition of cells having a stochastic structure elevation pattern.

With the objects of the invention in view, there is also provided a machine for processing printing material, in particular a sheet-processing rotary printing press for lithographic offset printing. The machine comprises at least one pseudo-stochastically structured cover of a cylinder for contacting printing material, the cover having pseudo-stochastic structuring according to the invention.

With the objects of the invention in view, there is furthermore provided a method for producing printed products. The method comprises providing at least one structured cover of a cylinder for contacting printing material and at least one screened printing form, and adapting a structuring of the cover and a screening of the printing form to one another to reduce or avoid moiré effects.

With the objects of the invention in view, there is additionally provided a method for producing printed products. The method comprises providing at least one pseudo-stochastically structured cover of a cylinder for contacting printing material, the cover having pseudo-stochastic structuring, providing at least one pseudo-stochastically screened printing form, the printing form having pseudo-stochastic screening, and adapting the pseudo-stochastic structuring of the cover and the pseudo-stochastic screening of the printing form to one another to reduce or avoid moiré effects.

With the objects of the invention in view, there is concomitantly provided a method for microstamping printed products. The method comprises providing at least one pseudo-stochastically structured cover of a cylinder for contacting printing material, providing the cover with pseudo-stochastic structuring, and providing the pseudo-stochastic structuring of the cover with at least one microstamping region with the structuring to be transferred onto the printing material.

Other features which are considered as characteristic for the invention are set forth in the appended claims.

Although the invention is illustrated and described herein as embodied in a method for producing a pseudo-stochastic master surface, a master surface, a method for producing a cylinder cover, a cylinder cover, a machine processing printing material, a method for producing printed products and a method for microstamping printed products, it is nevertheless not intended to be limited to the details shown, since various modifications and structural changes may be made therein without departing from the spirit of the invention and within the scope and range of equivalents of the claims, noting that the invention and the advantageous developments thereof also represent advantageous developments of the invention in combination with one another.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
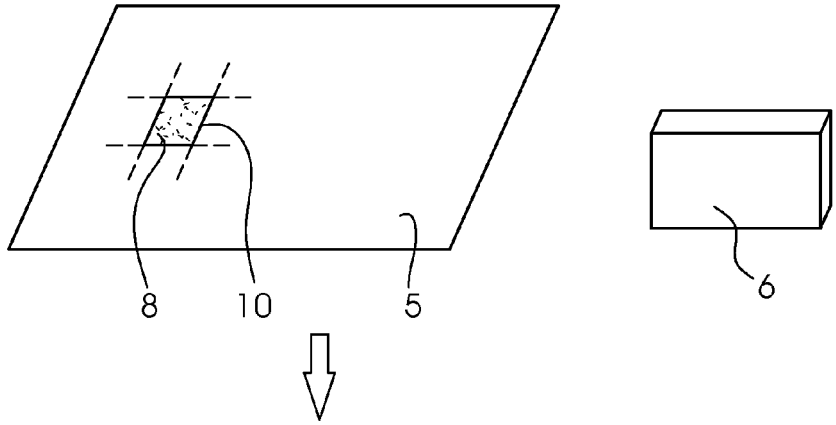
FIGS. 1A-C are diagrammatic, perspective views illustrating a sequence of one preferred exemplary embodiment of a method according to the invention for producing a cover.
Figure 1B:
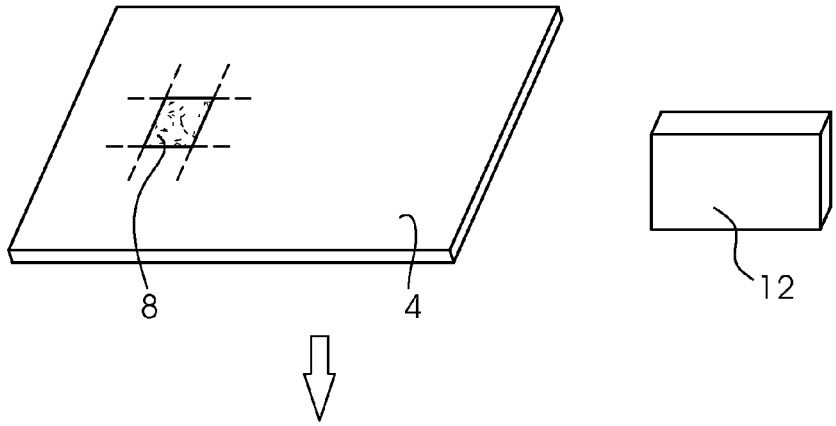
Figure 1C:
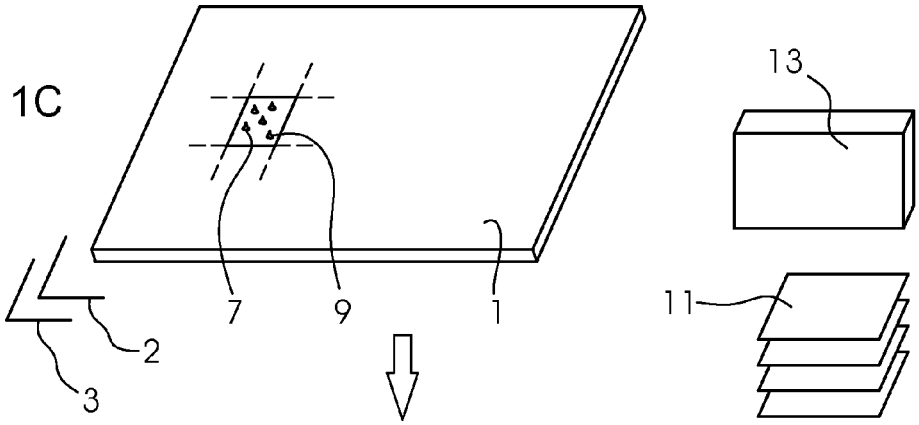

Referring now in detail to the figures of the drawings, in which mutually corresponding elements are each provided with the same designations, and first, particularly, to FIGS. 1A to 1C thereof, there is seen a sequence of a method according to the invention for producing a cover 1 (a so-called "jacket") of a cylinder 2 which makes contact with or contacts printing material, for example a cover for an impression cylinder or some other transport cylinder of a lithographic sheet-fed offset printing press 3 which prints or varnishes/coats paper, cardboard or films. In the two first method steps, the sequence also includes a method according to the invention for producing a pseudo-stochastic master surface 4 for producing a cover 1 of this type.

In a first step of the method according to the invention (see FIG. 1A), a digital master 5 is produced in a computer 6 for the material pseudo-stochastic master surface 4 and for the cover 1 which is produced by way of the latter. The digital master can be produced in the context of a computer-assisted jacket preliminary stage 6, in which method steps are carried out in a manner corresponding to method steps of a known prepress stage for producing digital masters for printing forms. For example, during the production of the digital master, a method which is known per se from the prepress stage of FM screening or its algorithms can be carried out. As a result of the use of a jacket preliminary stage based on corresponding methods of the prepress stage, a microstructure 7 of the cover to be produced can be constructed in a targeted manner. In this case, in particular, a pseudo-stochastic structure can also be produced in addition to the known regular or stochastic microstructures. In the context of the jacket preliminary stage, (mean) diameters and (mean) spacings of pseudo-stochastically distributed microsurfaces 8 are fixed, for example, and converted into a parameter which corresponds to the so-called area coverage in the production of printing forms. Structure elevations 9 correspond later to the microsurfaces: the diameter of the microsurface substantially defines the height of the associated structure elevation and the spacings of the microsurfaces define the spacings of the associated structure elevations.

The digital master 5 has a pseudo-stochastic distribution of microsurfaces 8. Cells 10 which are repeated periodically are provided and filled with a stochastic pattern of microsurfaces. In this case, the stochastic pattern is configured in such a way that, as a result of the periodic repetition of the pattern, no periodic patterns which can be discerned by the naked eye are produced in the digital master or on the master surface 4 or the cover 1, for example moiré effects. This use of cells which are repeated periodically, with the cells being filled with a stochastic pattern of microsurfaces, leads to an overall pattern which can be denoted "pseudo-stochastic" as above.

In addition, the pseudo-stochastic pattern can be configured in this case in such a way that, in later interaction of the cover 1 being produced with further covers during the production of printed products, no periodic patterns which can be discerned by the naked eye are produced on the printed product, for example moiré effects. This can be achieved, for example, by the stochastic patterns of the cells 10 of different digital masters 5 for different master surfaces 4 or covers, differing from one another, in a manner which is adapted to one another. So-called screen angles may be mentioned as an example of the adaptation (see the following description with regard to the adaptation of covers 1 and printing forms 11).

In addition, the pseudo-stochastic pattern can furthermore be configured in this case in such a way that, in later interaction of the produced cover 1 with the printing forms 11 during the production of printed products, no periodic patterns which can be discerned by the naked eye are produced on the printed product, for example moiré effects. This can be achieved, for example, by the stochastic patterns of the cells 10 of different digital masters 5 for different master surfaces 4 or covers and the stochastic patterns of the cells of different pseudo-stochastically screened printing forms (or their digital printing masters) differing from one another, in a manner which is adapted to one another. The following may be mentioned as an example: during the production of the so-called color separations and/or the corresponding printing forms, so-called screen angles of the color separations are adapted to one another in a manner which is known per se. There can be provision in the method according to the invention for the produced covers and not only the printing forms to also have screen angles, with the latter being adapted to the screen angles of the printing forms in such a way that, in particular, moiré effects are avoided or at least reduced.

There can be provision for the jacket preliminary stage and the printing form preliminary stage to be combined in the computer 6 (as common preliminary stage hardware), in order to simplify the adaptation of the respective pseudo-stochastic distributions, preferably using common preliminary stage software.

In a second step of the method according to the invention (see FIG. 1B), a master surface 4, for example a master film, a master plate or a master sheet, is produced from the digital master 5. This can take place with the use of an exposer 12 which is known per se and transfers the digital master onto a material surface 4 in a manner which is known per se, for example through the use of laser radiation.

The master surface 4 can be provided with a pseudo-stochastic microsurface positional distribution, that is to say the respective spatial positions of the individual microsurfaces 8 on or in the master surface are distributed pseudo-stochastically. This leads to the later structure elevations 9 likewise being distributed pseudo-stochastically, that is to say that their respective spacings from one another are also distributed pseudo-stochastically. As an alternative or in addition, the master surface can be provided with a pseudo-stochastic microsurface size distribution, that is to say the respective diameters or corresponding dimensions of the individual microsurfaces are distributed pseudo-stochastically. This leads to the heights of the later structure elevations likewise being distributed pseudo-stochastically.

In a third step of the method according to the invention (see FIG. 1C), a microstructured cover 1 or a jacket is produced from the master surface 4. This can take place in a galvanizing system 13 using a galvanic method which is known per se, as disclosed, for example, in International Publication No. WO 2006/112696 A2. In this case, i) the microsurfaces 8 of the distribution on the master surface 4 are provided with a so-called photoresist, ii) the master surface is then treated galvanically for a first time, afterward iii) it is passivated and iv) it is treated galvanically for a second time, and a negative form which is produced in this way is v) removed, vi) passivated and once again vii) treated galvanically and finally viii) the positive form 1 which is produced in this way is removed. The cover 1 which is produced or the covers which are produced and are adapted optionally to one another and/or optionally to the printing forms, can then be applied to the corresponding cylinders 2 and can be used. As an alternative to the galvanic method described, an etching method can also be used to produce a cover on the basis of the master surface.

Figure 2A:
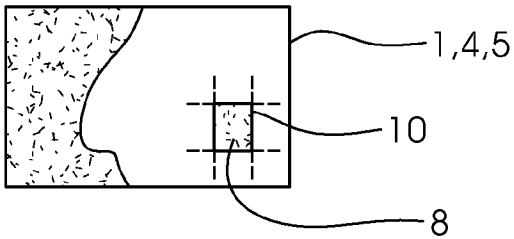
FIGS. 2A-G are plan views of preferred exemplary embodiments of pseudo-stochastic distributions of cells according to the invention which are repeated periodically.
Figure 2B:
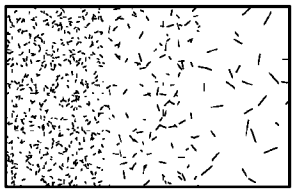
Figure 2C:
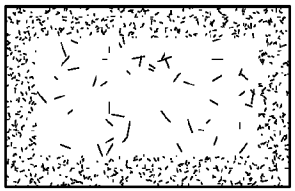
Figure 2D:
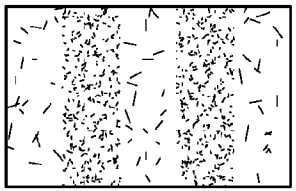
Figure 2E:
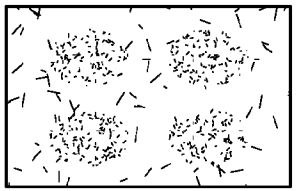
Figure 2F:
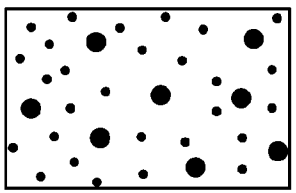
Figure 2G:
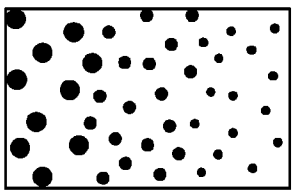

FIGS. 2A to 2G diagrammatically show different pseudo-stochastic patterns of cells 10 which are repeated periodically, in which the cells are filled with a stochastic pattern of microsurfaces 8. FIG. 2A shows (on the left hand side) a distribution of the microsurfaces of the digital master 5, the master surface 4 and the corresponding structure elevations 9 of the cover 1, in which the distribution is substantially uniform with regard to the area density (frequency) but is pseudo-stochastic. In addition, FIG. 2A shows (on the right hand half) a cell, from which the overall pattern is formed as a result of periodic repetition. FIGS. 2B to 2E in each case show a pseudo-stochastic distribution of the microsurfaces, in which distribution the area density of the microsurfaces varies. FIG. 2B shows an axially directed frequency change, FIG. 2C shows a radially directed frequency change, FIG. 2D shows a periodic frequency change in one dimension and FIG. 2E shows a periodic frequency change in two dimensions. FIGS. 2F and 2G in each case show a pseudo-stochastic distribution of microsurfaces of different sizes. FIG. 2F shows the combination of microsurfaces of two different sizes with a substantially uniform distribution of the microsurfaces, and FIG. 2G shows the combination of microsurfaces of different sizes with an axially directed size change.

Furthermore, the covers 1 which are produced according to the invention can also be used for microstamping or microembossing printing materials in accordance with German Published, Non-Prosecuted Patent Application DE 10 2008 013 322 A1, corresponding to U.S. Patent Application Publication No. US 2008/0236411 A1. To this end, an image, a text, a pattern, etc. (in short: an information item) is incorporated in a targeted manner in the jacket preliminary stage 6 into the pseudo-stochastic pattern which preferably cannot be discerned by the naked eye. Since it is "hidden" from the observer, this information item can serve as a security feature in checking the authenticity of printed products. For example, the height of individual structure elevations 9 and thus their effect as a respective stamping element only micrometers in size can be influenced in a targeted manner through the selection of microsurface diameters. As an alternative, there can also be provision for the microstamping structure 7 to produce a structure which can be discerned by the naked eye on the printing material, for example in order to improve its esthetic or functional effect.

Figure 3:
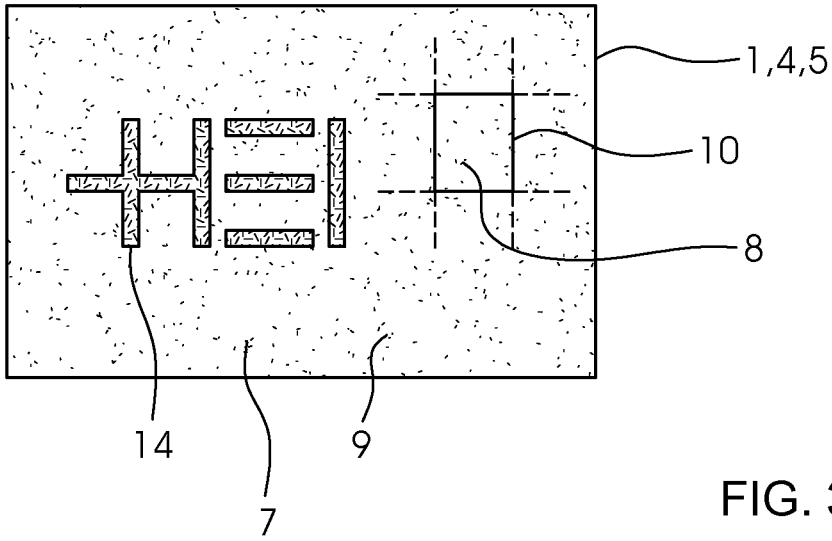
FIG. 3 is a plan view of one preferred exemplary embodiment of a pseudo-stochastic distribution of cells according to the invention which are repeated periodically.

FIG. 3 shows a pseudo-stochastic pattern of cells 10 which are repeated periodically (right hand half), wherein the cells are filled with a stochastic pattern of microsurfaces 8. In addition, a logo "HEI" is incorporated as a hidden information item 14 (left hand half), wherein the logo is not to be discernible by the naked eye later on the printed product. The logo can, for example, have a pattern which differs from the surrounding area, and can be made visible by auxiliary measures.

The invention claimed is:

1. A method for producing a cover of an impression cylinder contacting printing material, the method comprising the following steps:

producing a pseudo-stochastic master surface including a pseudo-stochastic distribution of microsurfaces due to a regular repetition of cells having a stochastic microsurface pattern on the master surface; and galvanically producing the impression cylinder cover contacting printing material by utilizing the pseudo-stochastic master surface.

2. The method according to claim 1, which further comprises providing the master surface with a pseudo-stochastic microsurface positional distribution.

3. The method according to claim 1, which further comprises providing the master surface with a pseudo-stochastic microsurface size distribution.

4. A method for producing printed products, the method comprising the following steps:

providing at least one pseudo-stochastically structured and galvanically produced cover of an impression cylinder contacting printing material, the cover having pseudo-stochastic structuring;

providing at least one pseudo-stochastically screened printing form, the printing form having pseudo-stochastic screening; and adapting the pseudo-stochastic structuring of the cover and the pseudo-stochastic screening of the printing form to one another to reduce or avoid moiréeffects.

* * * * *